US005484148A

United States Patent [19]

Olivieri

[11] Patent Number: 5,484,148

[45] Date of Patent: Jan. 16, 1996

[54] SKATE BLADE ASSEMBLY WITH REINFORCEMENT INSERT

[75] Inventor: Icaro Olivieri, Westmount, Canada

[73] Assignee: Canstar Sports Group Inc., Ville Mont-Royal, Canada

[21] Appl. No.: 260,375

[22] Filed: Jun. 14, 1994

[51] Int. Cl.[6] ..... A63C 1/30

[52] U.S. Cl. ..... 280/11.18; 280/11.17

[58] Field of Search ..... 280/11.17, 11.18, 280/11.12, 28

[56] References Cited

U.S. PATENT DOCUMENTS

| | | | |
|---|---|---|---|
| 475,650 | 5/1892 | Wierda | 280/11.12 |
| 1,371,609 | 3/1921 | Drevitson | 280/11.17 |
| 1,666,690 | 4/1928 | Drevitson | 280/11.17 |
| 2,188,971 | 2/1940 | Adonizio | 280/11.17 |
| 2,203,278 | 6/1940 | Foley | 280/11.18 X |
| 2,242,870 | 5/1941 | Prosey | 280/11.18 |
| 2,414,967 | 1/1947 | Meyers | 280/11.18 X |
| 2,520,548 | 8/1950 | Jack | 280/11.17 |
| 3,026,119 | 3/1962 | Bauer | 280/11.18 |
| 3,120,963 | 2/1964 | Seckel | 280/28 |
| 3,279,807 | 10/1966 | Jacobson | 280/11.17 |
| 5,248,156 | 9/1993 | Cann et al. | 280/11.18 |
| 5,332,242 | 7/1994 | Cann et al. | 280/11.18 |
| 5,388,845 | 2/1995 | Soo | 280/11.17 |

FOREIGN PATENT DOCUMENTS

| | | | |
|---|---|---|---|
| 254009 | 5/1967 | Austria | 280/11.18 |
| 9408668 | 4/1994 | WIPO | 280/11.18 |

*Primary Examiner*—Brian L. Johnson
*Attorney, Agent, or Firm*—R. Craig Armstrong

[57] ABSTRACT

A rigid reinforcement member extends longitudinally along the neck portion of the skate blade holder, to reduce stress and improve force transfer. The blade holder has a longitudinal slot running along the bottom thereof to receive a blade or runner, which is secured in the slot. At least one rigid reinforcement member runs along at least the neck portion, within the slot and above the runner, the slot being enlarged at the location of the reinforcement member(s) in order to accommodate the member(s). Preferably, the reinforcement member is in one piece, including an upper web portion and an integral channel with a cross-section in the form of inverted U-shape beneath the upper web portion. The arms of the U-shape run alongside the runner, one on either side of the runner, and the base of the U-shape overlies the top of the runner and follows the shape thereof. Preferably, the rigid reinforcement member is of a reinforced plastic composite material, although a metal could also be used. The increased rigidity of the blade holder permits the use of a lighter runner, which may be provided by using a runner with a number of cut-out areas.

10 Claims, 4 Drawing Sheets

SKATE BLADE ASSEMBLY WITH REINFORCEMENT INSERT

BACKGROUND OF THE INVENTION

This invention relates to ice skates, and in particular to an improved skate blade support.

In conventional skate blade assemblies such as those manufactured and sold by Canstar Sports Group Inc. under its TUUK trademark, a blade holder, which is secured to the skate boot, has a longitudinal slot into which the blade or "runner" is installed.

This blade assembly has been extremely successful. However, in the constant quest for improvement, it has been determined that it would be desirable to provide greater rigidity along the central portion of the blade holder, i.e. along the neck portion between the heel and toe portions. This would reduce the stress on the neck portion of the blade holder, which is desirable because the plastic of the blade holder is more brittle when under stress. Reinforcement along the neck portion of the blade holder would reduce the stress, and also provide better force transfer between the ice and the skate boot, via the attachments between the boot and the front and rear portions of the blade holder.

SUMMARY OF THE INVENTION

In view of the foregoing, the invention provides a rigid reinforcement member extending longitudinally along the at least the neck portion of the blade holder, to reduce stress and improve force transfer.

More particularly, the skate blade assembly of the invention has an elongated blade holder having a front portion for attachment beneath the toe area of the skate boot, a rear portion for attachment beneath the heel area of the skate boot, and an integral neck portion between the front and rear portions. The blade holder has a longitudinal slot running along the bottom thereof to receive a blade or "runner", which is secured in the slot. At least one rigid reinforcement member runs along at least the neck portion, within the slot and above the runner, the slot being enlarged at the location of the reinforcement member(s) in order to accommodate the member(s).

Preferably, the reinforcement member is in one piece, including an upper web portion and an integral channel with a cross-section in the form of inverted U-shape beneath the upper web portion. The arms of the U-shape run alongside the runner, one on either side of the runner, and the base of the U-shape overlies the top of the runner and follows the shape thereof.

Preferably, the rigid reinforcement member is of a reinforced plastic composite material, although a metal could also be used.

Further features of the invention will be described or will become apparent in the course of the following detailed description, or from an examination of the accompanying drawings.

BRIEF DESCRIPTION OF THE DRAWINGS

The invention will be better understood from the ensuing detailed description of the preferred embodiment, by way of example only. Reference will be made to the accompanying drawings, in which.

DETAILED DESCRIPTION

Figure 1:
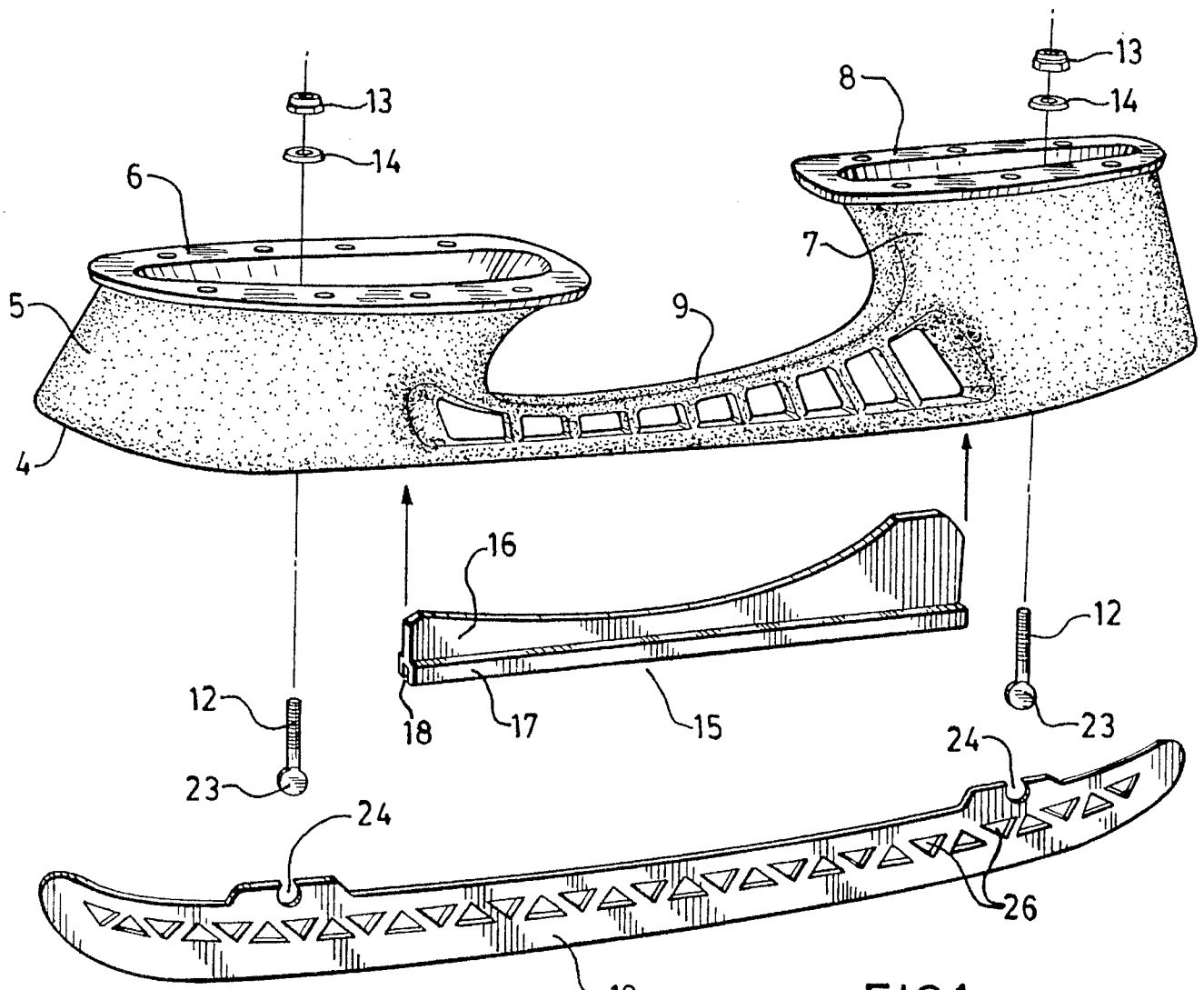
FIG. 1 is an exploded perspective view of the blade assembly, showing a conventional blade holder and runner, with the reinforcement insert of the invention.
Figure 2:
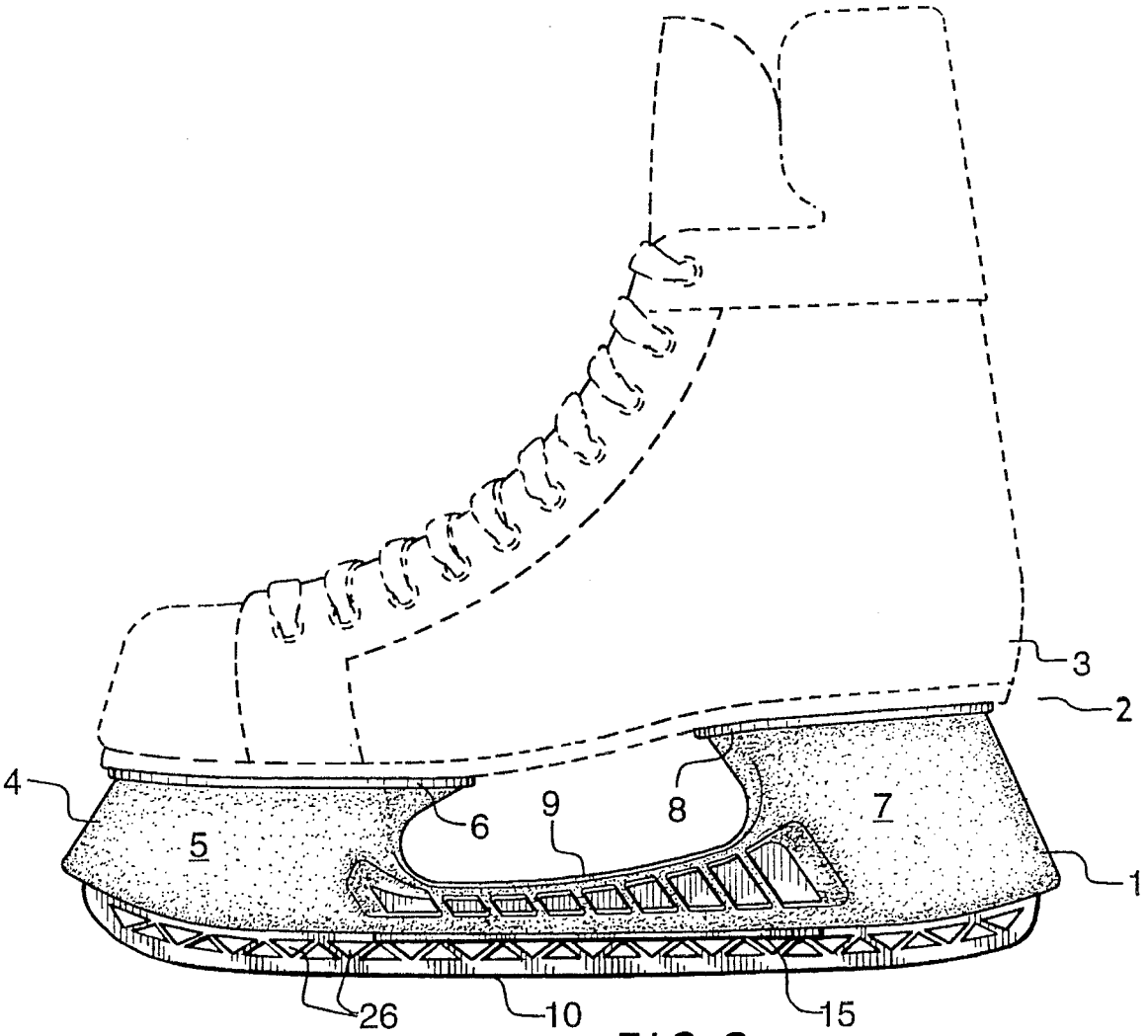
FIG. 2 is a side view of the assembled blade assembly, with a skate boot shown in phantom lines.
Figure 3:
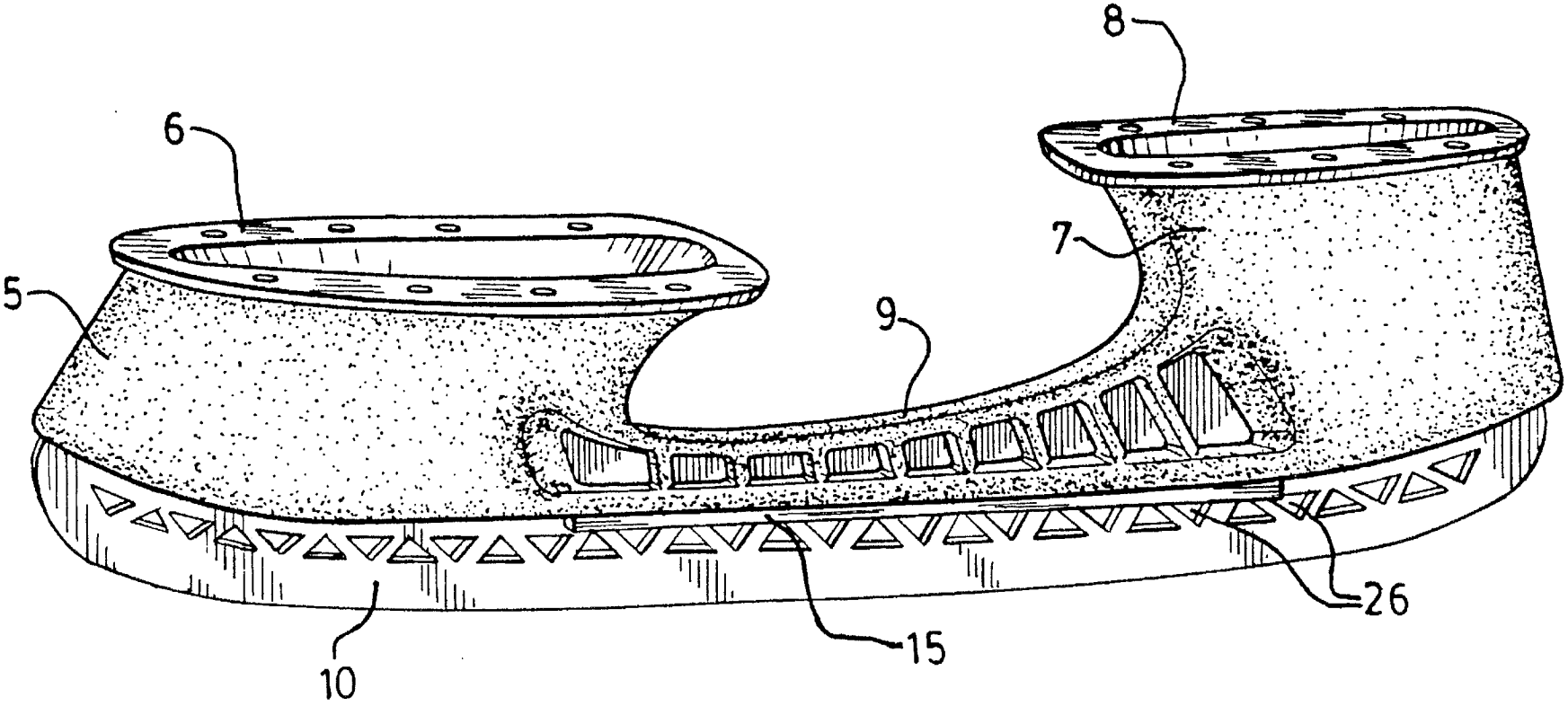
FIG. 3 is a side perspective view of the assembled blade assembly.
Figure 4:
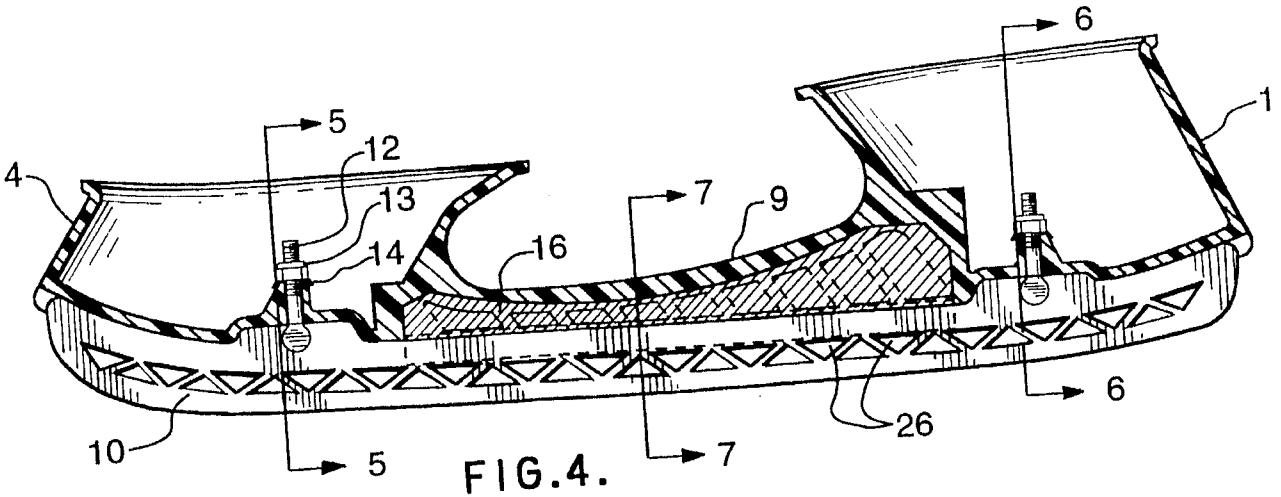
FIG. 4 is a side cross-sectional view of the assembled blade assembly.
Figure 7:
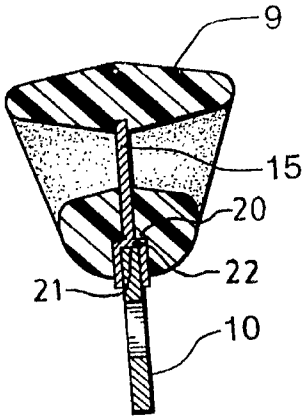
FIG. 7 is a cross-section of the blade assembly at 7—7 in FIG. 4.
Figure 6:
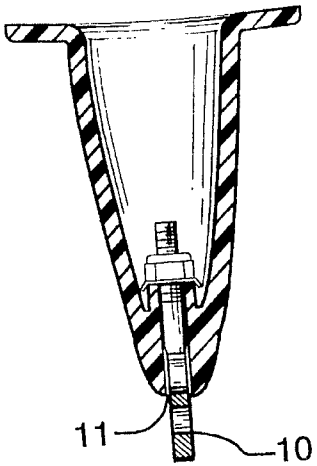
FIG. 6 is a cross-section of the blade assembly at 6—6 in FIG. 4.
Figure 5:
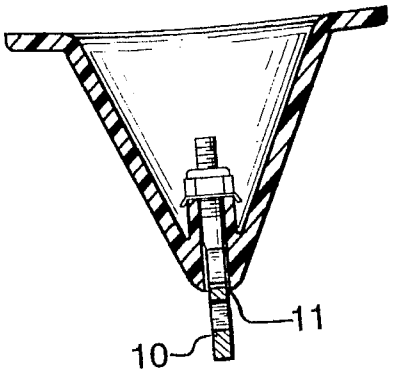
FIG. 5 is a cross-section of the blade assembly at 5—5 in FIG. 4.

Referring to the accompanying drawings, the skate blade assembly 1 is part of a typical skate 2, which also includes a boot 3. The blade assembly includes an elongated blade holder 4 having a front portion 5 with a front pad 6 for attachment beneath the toe area of the boot, a rear portion 7 with a rear pad 8 for attachment beneath the heel area of the skate boot, and an integral neck portion 9 between the front and rear portions. A blade or "runner" 10 is secured in a longitudinal slot 11 running along the bottom of the blade holder, by pins 12 which are pulled upwardly by nuts 13 which contact collars 14. The pins have rounded, flattened heads 23 which fit into appropriately dimensioned rounded slots 24 in the runner.

In the invention, at least one rigid reinforcement member 15 runs along at least the neck portion, within the slot and above the runner, the slot being enlarged at the location of the reinforcement member(s) in order to accommodate the member(s). Conceivably, there could be more than one such member. There could be two such members, for example, one on either side of the runner.

Preferably, though, the reinforcement member is in one piece, including an upper web portion 16 extending from an upper surface 20 of a horizontal portion 22 and an integral channel 17 with a cross-section in the form of inverted U-shape beneath the upper web portion. The arms of the U-shape extend downwardly from a lower surface 21 of horizontal portion 22 and run alongside the runner, one on either side of the runner, and the base of the U-shape overlies the top of the runner and follows the shape thereof, the runner being accommodated within the slot 18.

It is an advantage of the invention that the reinforced blade holder allows the runner itself to be slightly less rigid. The runner therefore can be reduced in weight, for example by a plurality of cutouts 26. This reduces the overall weight of the blade assembly as well, since more weight is removed from the runner than is added by the reinforcement member.

Preferably, the rigid reinforcement member is of a reinforced plastic composite material, such as an epoxy/graphite fiber mix, although a metal could also be used.

The reinforcement member provides the desired greater rigidity along the neck portion of the blade holder, thereby reducing the stress on the blade holder. As mentioned previously, this is desirable because the plastic of the blade holder, typically of ZYTEL (trademark) nylon, is more brittle when under stress. The reinforcement member reduces the stress, and also provides better force transfer between the ice and the skate boot, via the attachments at the front and rear pads between the boot and the blade holder.

The invention has been described with particular reference to a preferred embodiment. Various modifications can be made, of course, without departing from the spirit of the invention, and such modifications are intended to be within the scope of the following claims whether or not expressly described in the above text or illustrated in the accompanying drawings.

As one example of such modifications, it should be readily apparent that the reinforcement insert could extend for the whole length or substantially the whole length of the blade holder, not just along the neck portion.

I claim:

1. An ice skate blade assembly for attachment to a skate boot, said skate blade assembly comprising:

an elongated blade holder having a front portion for attachment beneath the toe area of the skate boot, a rear portion for attachment beneath the heel area of the skate boot, and an integral neck portion between said front and rear portions;

a rigid reinforcement member having an elongated inverted U-shaped portion comprising a horizontal portion having an upper surface and a lower surface and integral sidewall portions extending downwardly from said lower surface and having an integral elongated web portion extending a substantial distance upwardly from a central longitudinal axis of said horizontal portion upper surface said web portion and said U-shaped portion being snugly accommodated and secured within a longitudinal slot in said blade holder, said reinforcement member extending at least the length of said neck portion; and a runner snugly accommodated and secured within said slot and said U-shaped portion of said reinforcement member, extending downwardly therefrom, said runner having an upper surface which is in continuous contact with said horizontal portion of said reinforcement member.

2. An ice skate blade assembly as recited in claim 1, where said rigid reinforcement member is of a reinforced plastic composite material.

3. An ice skate blade assembly as recited in claim 1, where said rigid reinforcement member is of metal.

4. An ice skate blade assembly as recited in claim 1, where said runner has a plurality of cut-out areas spaced longitudinally therealong and extending a substantial portion of the overall length of the runner, to reduce the weight of said runner.

5. An ice skate blade assembly as recited in claim 4, where said cutout areas are arranged in a central portion of the runner between a solid upper area of the runner and a solid lower area of the runner, where said cutouts are triangular, each successive triangular cutout being inverted relative to a predecessor, so as to define ribs between the cutouts, each successive rib angling forwardly or rearwardly in alternating fashion.

6. An ice skate comprising a boot and a blade assembly secured beneath said boot, said blade assembly comprising:

an elongated blade holder having a front portion for attachment beneath the toe area of the skate boot, a rear portion for attachment beneath the heel area of the skate boot, and an integral neck portion between said front and rear portions;

a rigid reinforcement member having an elongated inverted U-shaped portion comprising a horizontal portion having an upper and lower surface and integral sidewall portions extending downwardly from said lower surface, and having an integral elongated web portion extending a substantial distance upwardly from a central longitudinal axis of said horizontal portion upper surface, said web portion and said U-shaped portion being snugly accommodated and secured within a longitudinal slot in said blade holder, said reinforcement member extending at least the length of said neck portion; and a runner snugly accommodated and secured within said slot and said U-shaped portion of said reinforcement member, extending downwardly therefrom, said runner having an upper surface which is in continuous contact with said horizontal portion of said reinforcement member.

7. An ice skate as recited in claim 6, where said rigid reinforcement member is of a reinforced plastic composite material.

8. An ice skate as in claim 6, where said rigid reinforcement member is of metal.

9. An ice skate as recited in claim 6, where said runner has a plurality of cut-out areas spaced longitudinally therealong and extending a substantial portion of the overall length of the runner, to reduce the weight of said runner.

10. An ice skate as recited in claim 9, where said cutout areas are arranged in a central portion of the runner between a solid upper area of the runner and a solid lower area of the runner, where said cutouts are triangular, each successive triangular cutout being inverted relative to a predecessor, so as to define ribs between the cutouts, each successive rib angling forwardly or rearwardly in alternating fashion.

* * * * *

UNITED STATES PATENT AND TRADEMARK OFFICE
CERTIFICATE OF CORRECTION

Patent No. 5,484,148
Dated January 16, 1996
Inventor Icaro Olivieri

It is certified that error appears in the above-identified patent and that said Letters Patent is hereby corrected as shown below:

Col. 3

Claim 1, line 23 after "said lower surface" insert a comma (,);
line 26 after "portion upper surface", insert a comma (,).

Signed and Sealed this

Twenty-second Day of October, 1996

Bruce Lehman

*Attest:*

BRUCE LEHMAN

*Attesting Officer*

*Commissioner of Patents and Trademarks*